US006440050B1

(12) United States Patent
Capparelli et al.

(10) Patent No.: US 6,440,050 B1
(45) Date of Patent: Aug. 27, 2002

(54) METHOD OF FORMING A VARIABLE SIZED AND SHAPED PIZZA BOX AND APPARATUS THEREOF

(76) Inventors: Patsy R. Capparelli, 1770 Indian Trail Rd. Suite 200, Norcross, GA (US) 30093; Timothy D. Davis, 1770 Indian Trail Rd. Suite 200, Norcross, GA (US) 30093

( * ) Notice: Subject to any disclaimer, the term of this patent is extended or adjusted under 35 U.S.C. 154(b) by 130 days.

(21) Appl. No.: 09/663,984

(22) Filed: Sep. 19, 2000

(51) Int. Cl.[7] ..... B65D 5/54; B31B 1/25

(52) U.S. Cl. ..... 493/59; 229/101.2; 229/115; 493/153; 493/160; 493/162

(58) Field of Search ..... 493/194, 160, 493/168, 199, 153, 59, 162; 229/101, 101.2, 115, 116, 120.01, 120.11

(56) References Cited

U.S. PATENT DOCUMENTS 1,845,456 A * 2/1932 Wagner ..... 493/162
2,022,305 A * 11/1935 Wellman ..... 493/59
2,947,637 A * 8/1960 Fobiano ..... 229/120.012
3,116,868 A * 1/1964 Lazure ..... 229/101.2
3,310,220 A * 3/1967 Feldman ..... 229/101
3,371,842 A * 3/1968 Hechtmann et al. ..... 229/101
4,008,849 A * 2/1977 Baber ..... 229/235
4,113,100 A * 9/1978 Soja et al. ..... 229/112
4,235,364 A * 11/1980 Baker ..... 229/101
4,452,367 A 6/1984 Wein
4,535,928 A * 8/1985 Capo ..... 229/115
4,905,837 A * 3/1990 Schuster et al. ..... 229/120.011
5,071,062 A 12/1991 Bradley
6,155,477 A * 12/2000 Herrera et al. ..... 229/101

* cited by examiner

*Primary Examiner*—Stephen F. Gerrity
(74) *Attorney, Agent, or Firm*—Barry E. Kaplan, Esq.; Hughes & Kaplan

(57) ABSTRACT

A generally rectangular blank of preferably cardboard material having a multitude of strategically positioned cut lines, fold lines, and perforated tear lines. The present invention can be formed into at least two differently shaped and sized boxes; thus, efficiently accommodating a whole pizza in its original rectangular shape, and efficiently accommodating a slice or other portion of pizza in its reduced-size, triangular shape. In addition to the typical cut and fold lines found in a common pizza box, the present invention provides, generally, eight sets of perforated tear lines strategically positioned such that a rectangularly-shaped pizza box may be torn along the perforated tear lines to form a generally triangularly-shaped, smaller dimensioned pizza box.

12 Claims, 3 Drawing Sheets

METHOD OF FORMING A VARIABLE SIZED AND SHAPED PIZZA BOX AND APPARATUS THEREOF

TECHNICAL FIELD

The present invention relates generally to food service containers, and, more particularly, to a method of forming a variable sized and shaped pizza box and apparatus thereof.

BACKGROUND ART

Throughout the world, and especially in the United States, pizza has been and continues to be a well known and loved meal. Going out for pizza, or its ordering in, has become a tradition for many individuals, families, and groups. In order to transport a pizza during delivery, to store a pizza for later consumption, or to take home leftover pizza, the well well-known, typically rectangular, cardboard pizza box is utilized. Although these prior art pizza boxes are suitable for whole pizzas, their designs are deficient for slices or portions of a pizza amounting to less than a whole pizza.

For instance, a whole pizza pie is typically round with a plurality of cuts therethrough to form a plurality of generally triangularly-shaped slices. After some of the slices have been removed, the remaining slices no longer fit snugly within the rectangular pizza box. As a result, during transportation and storage, the remaining pizza slices typically slide about the inside of the box, often causing undesirable dislocation of the pizza toppings.

Moreover, one of the most prominent disadvantages associated with prior art pizza boxes is their inefficient of use of space. In other words, for storage, many people will place left-over pizza inside the refrigerator in the original pizza box. The large rectangular box inefficiently occupies significantly more space in the refrigerator than is needed. In addition, the standard size prior-art pizza box does not fit within a standard size microwave oven; thus, one must remove the pizza from its box prior to its re-heating.

In an attempt to overcome the abovementioned disadvantages, a design has been proposed wherein a standard rectangular pizza box has a plurality of perforated score lines for tearing and folding therealong to form a generally smaller rectangular pizza box. An example of such a design may be found by reference to U.S. Pat. No. 5,071,062 to Bradley et al. Although Bradley reduces the overall size of the original standard pizza box, it fails to provide a spatially efficient box that conforms to the shape of typical pizza slices. In other words, triangularly-shaped pizza slices placed within the reduced sized rectangular pizza box results in unused space and, thus, a spatially inefficient design.

It is, therefore, readily apparent that a new and improved apparatus and method of forming a variable sized and shaped pizza box is needed that, in its original state, can contain a whole pizza therein, and that, in its altered and reduced state, is transformable into a generally triangularly-shaped pizza box that efficiently can contain a smaller portion of pizza. It is, therefore, to the provision of such an improvement that the present invention is directed.

BRIEF SUMMARY OF THE INVENTION

Briefly described, in a preferred embodiment, the present invention both overcomes the above-mentioned disadvantages, and meets the recognized needs for such a device, by providing an apparatus and method of forming a variable sized and shaped pizza box.

More specifically, in a preferred embodiment, the present invention comprises a generally rectangular blank of preferably cardboard material having a multitude of strategically positioned cut lines, fold lines, and perforated tear lines. The present invention can be formed into at least two differently shaped and sized boxes; thus, efficiently accommodating a whole pizza in its original rectangular shape and efficiently accommodating a slice, or other portion, of pizza in its reduced-size, triangular shape.

The original rectangularly-shaped pizza box, preferably, is a commonly-known, prior art pizza box having the typical fold and cut lines. The present invention, however, may be incorporated into any known rectangularly-shaped folding pizza box generally having fold lines formed around all four edges of the box and spaced a distance therefrom for forming the bottom two side walls, the bottom front side wall, the top two side walls, and the top front side wall, and two spaced-apart fold lines formed near the center of the blank for forming the rear side wall of the pizza box.

In addition to the typical cut and fold lines found in a common pizza box, the present invention comprises, generally, eight sets of perforated tear lines. The first set generally begins at one side edge of the pizza box and extends approximately along and parallel with the fold line proximal to the front edge, to a predetermined point preferably less than half the width of the pizza box. Next, extending therefrom at approximately a 135-degree angle is the second set of perforated tear lines. The second set generally extends to the fold line formed proximal to the other side edge of the pizza box. Preferably located at approximately the mid-point between the two side edges is the third set of perforated tear lines. This set interrupts the second set by forming a generally U-shaped tab portion extending generally downward from, and perpendicular to, the second set. The tab portion formed by the third set is used to secure the triangularly-shaped pizza box in the closed position.

The fourth set extends upwardly from the end of the second set and generally along the fold line to approximately the first spaced-apart fold line formed near the center of the blank for forming the rear side wall of the pizza box when folded. The fifth set extends generally outward to the proximal side edge. The sixth set begins generally at the intersection of the second spaced-apart fold line formed near the center and the side edge fold line proximal thereto, and extends upwardly along said the side edge fold line a predetermined distance equal to approximately the height of a side wall of the box. The seventh set extends therefrom at approximately a 45-degree angle until the seventh set intersects the fold line proximal to the rear edge of the blank, wherein the eighth set extends generally along the fold line proximal to the rear edge to the same side edge as the first set begins.

Preferably, two additional fold lines are formed in the blank to assist in folding the two edges formed by the second and seventh set of perforated tear lines to form one side of the triangularly-shaped pizza box when in the closed position. In addition, a slit is formed proximal to the fold line that is distal from the tab portion formed by the third set of perforated tear lines for receiving the tab portion therein to secure the triangularly-shaped pizza box in the closed position. The perforations also serve to vent the steam generated within the box to prevent the pizza from becoming soggy.

Thus, an object, feature and advantage of the present invention is to provide a new and improved variable sized and shaped pizza box that is generally rectangular in its initial state for accommodating a whole pizza and is triangularly shaped in its altered state for accommodating a slice or slices smaller portion of pizza.

Another object, feature, and advantage of the present invention is to provide a new and improved variable sized and shaped pizza box having a plurality of strategically placed perforated tear lines and fold lines such that a standard rectangular pizza box can be easily reduced to a smaller, more efficient, triangularly-shaped pizza box.

A further object, feature, and advantage of the present invention is to provide a new and improved variable sized and shaped pizza box that can be reconfigured without the need for tools or utensils.

Another and further object, feature, and advantage of the present invention is to provide a new and improved variable sized and shaped pizza box that does not require the removal of the pizza in order to reconfigure the box.

Yet another object, feature, and advantage of the present invention is to provide a new and improved variable sized and shaped pizza box wherein the reconfigured box may fit into a standard-sized microwave oven.

Still another object, feature, and advantage of the present invention is to provide a new and improved variable sized and shaped pizza box having perforations formed therein for venting steam generated by a warm pizza contained inside the box in order to prevent the pizza from becoming soggy.

Other objects, features, advantages, and characteristics of the present invention, as well as the methods of operation, construction, and function of the related elements and structure will become more apparent upon consideration of the following description and the appended claims, with reference to the accompanying drawings, all of which form a part of this specification.

BRIEF DESCRIPTION OF THE FIGURES

The present invention will be better understood by reading the Detailed Description of the Preferred Embodiment with reference to the accompanying drawing Figures, in which like reference numerals denote similar structure and refer to like elements throughout, and in which.

DETAILED DESCRIPTION OF THE PREFERRED EMBODIMENT

Figure 1:
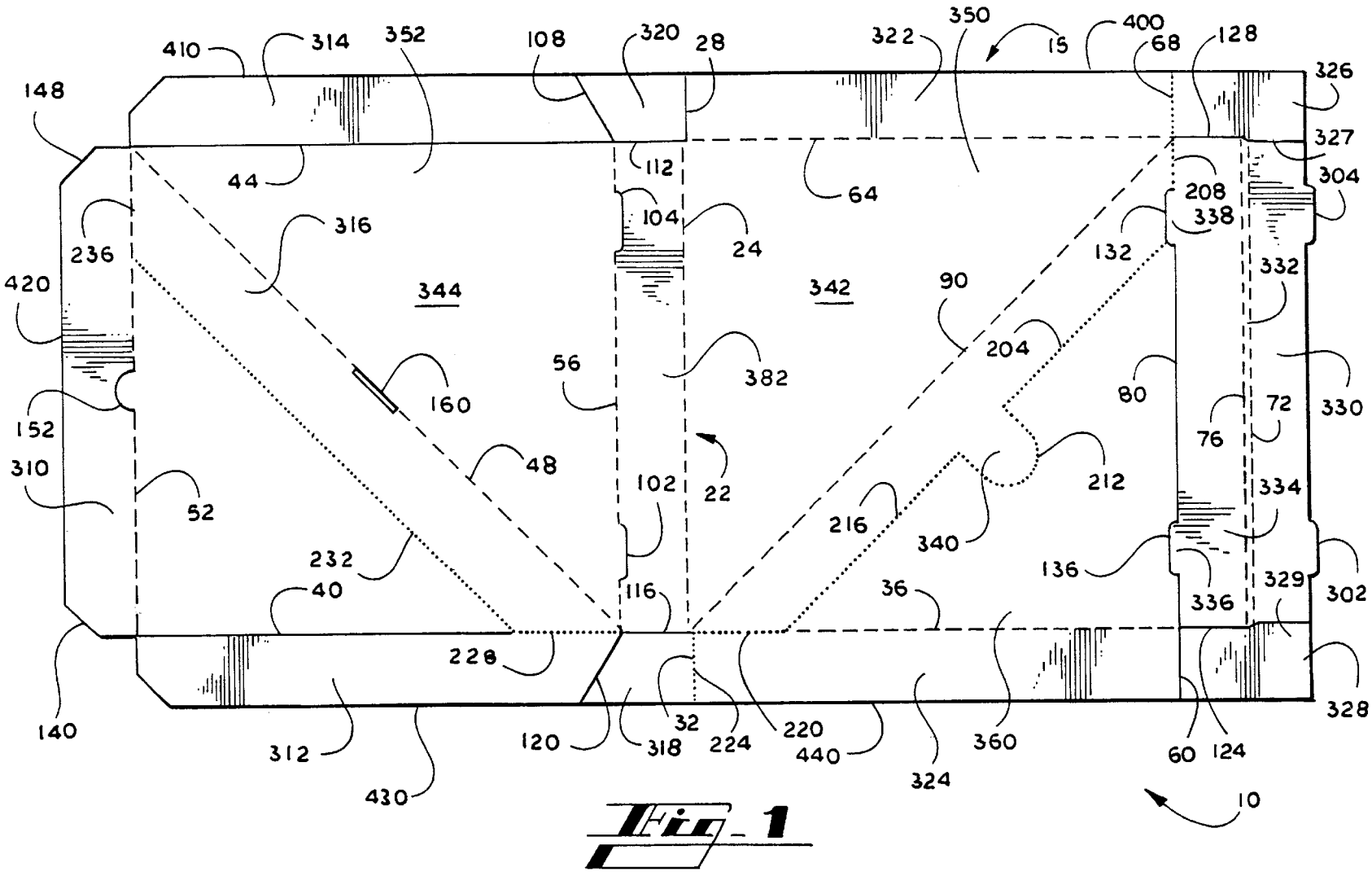
FIG. 1 is a top view of the apparatus according to a preferred embodiment of the present invention showing the cut lines, fold lines, and perforated tear lines.

In describing the preferred and alternate embodiments of the present invention illustrated in the Figures, specific terminology is employed for the sake of clarity. The invention, however, is not intended to be limited to the specific terminology so selected, and it is to be understood that each specific element includes all technical equivalents that operate in a similar manner to accomplish a similar purpose.

For purposes of clarity, and with reference to the following descriptions of device 10 of the present invention and the prior art pizza box 15, fold lines 20 are shown, generally, in the Figures as dashed lines with reference numbers between 20–99; cut lines 100 are shown, generally, in the Figures as solid lines with reference numbers between 100–199; tear perforations 200 are shown, generally, in the Figures as spaced-apart dots with reference numbers between 200–299; and principal portions of device 10, generally, are designated in the Figures with reference numbers 300–399.

Referring first to FIG. 1, a common pizza box 15, well-known within the art, is shown. The pizza box 15 has cut lines and fold lines according to established prior art boxes. Although only one embodiment of commonly known pizza boxes is shown, it should be noted that the present invention 10 may be incorporated within any rectangularly-shaped pizza box without departing from the scope of the invention. In addition, because pizza boxes 15 are well known within the art, the description of prior art pizza box 15 will be limited.

In FIG. 1, pizza box 15 is shown with the inside surface of pizza box 15 facing up, as though to receive a pizza. Bottom piece 342, defined by and between fold lines 22, 64, 80 and 36, is generally the bottom of pizza box 15 wherein a pizza is placed during use. Top piece 344 is generally known as the top of the pizza box 15 with pieces 310, 312, 314, 322, 324, 330, and 334 generally defining the sides of the pizza box 15. To form a box, pieces 310, 312, 314, 318, 320, 322, 324, 326, 328, 334 are generally folded approximately ninety degrees upward. Pieces 318, 320, 326, 328 are then folded approximately ninety degrees inward toward piece 342 with portions 329, 327 of pieces 328, 326, respectively, resting within cut sections 336, 338, respectively. Next, piece 330 is folding downward 180-degrees toward piece 342 with extensions 302, 304 fitting within and secured by cut sections 336, 338, respectively; thereby, locking pieces 328, 327 into position and thus forming the rigid front side of pizza box 15. To close pizza box 15, piece 344 is rotated approximately one hundred eighty degrees wherein pieces 310, 312, 314 fit within pieces 330, 324, 322, respectively, and wherein the edges of pieces 310, 312, 314 rest against piece 342, thus shaping pizza box 15.

Figure 2:
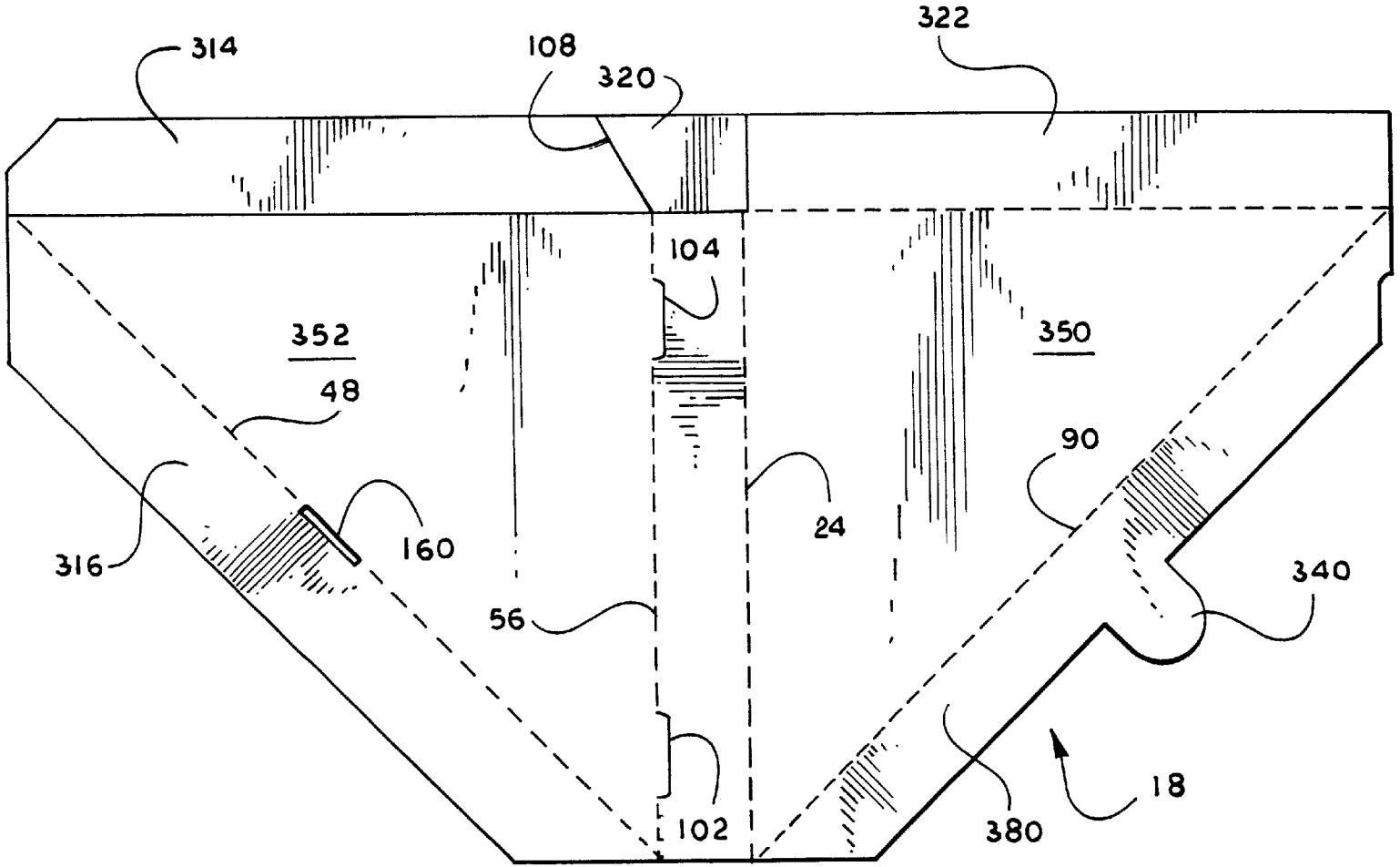
FIG. 2 is a top view of the reduced-sized triangular apparatus according to a preferred embodiment of the present invention after tearing along the perforated tear lines.

With continuing reference to FIG. 1, the present invention 10 is shown wherein a plurality of perforated tear lines and additional fold lines are formed in pizza box 15 such that a user can tear or cut along perforated tear lines to form a blank, as best seen in FIG. 2, for a generally triangularly-shaped pizza box 18. It should be noted that, for purposes of illustration, perforated tear lines 208, 220, 224, 228, and 236 are shown in FIG. 1 as overlaying fold lines 68, 36, 32, 40 and 52, respectively; thus, perforated tear lines 208, 220, 224, 228, 236 are preferably positioned within the creases of fold lines 68, 36, 32, 40 and 52, respectively.

More specifically, perforated tear line 208 begins at edge 400 and extends along fold line 68 to approximately piece 338, wherein perforated tear line 204 extends approximately at a 135-degree angle therefrom. Approximately at the center of piece 342, perforated tear lines 212, formed generally in a U-shape, extend downward from perforated tear line 204 to form tab portion 340. Perforated tear line 216 continues to extend along the same line as perforated tear line 204 to fold line 36, wherein perforated tear line 220 extends upward along fold line 36 to approximately fold line 32. Tear line 224 extends along fold line 32 to edge 440. Perforated tear line 236 preferably begins at fold line 44 proximal to edges 420 and 410 and extends along fold line 52 to approximately the same vertical distance away from the edge as perforated tear line 208 at the opposing side. Extending at approximately a 225-degree angle from perforated tear line 236 is perforated tear line 232. Perforated tear line 232 extends to fold line 40, wherein perforated tear line 228 extends downward along fold line 40 to cut line 120.

Fold line 48 preferably is formed a distance from, and parallel to, perforated tear line 232, wherein fold line 48 extends approximately from fold line 44 to fold line 40. Positioned approximately at the center of fold line 48 is slit 160, dimensioned for receiving tab portion 340. The distance between fold line 48 and perforated tear line 232 is approximately equal to the width of pieces 314, 322.

Formed on piece 350, parallel to and a distance from perforated tear lines 216 and 204, is fold line 90. Fold line 90 extends from fold line 64 to approximately fold line 36. The distance between fold line 90 and perforated tear lines 216, 204 is approximately equal to the width of pieces 314 and 322, and the distance between fold line 48 and perforated tear line 232.

Figure 3:
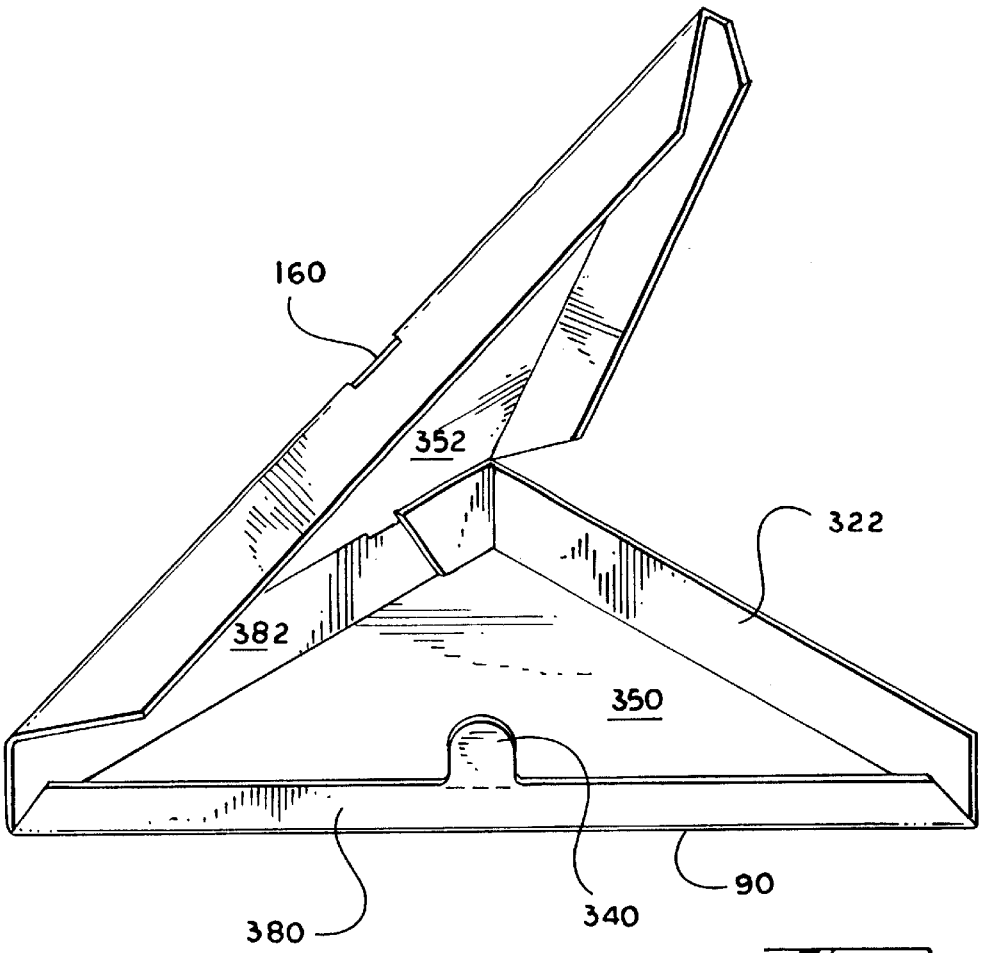
FIG. 3 is a perspective view of the reduced-sized triangular apparatus according to a preferred embodiment of the present invention in an open state; and, FIG. 4 is a perspective view of the reduced-sized triangular apparatus according to a preferred embodiment of the present invention in a closed state.
Figure 4:
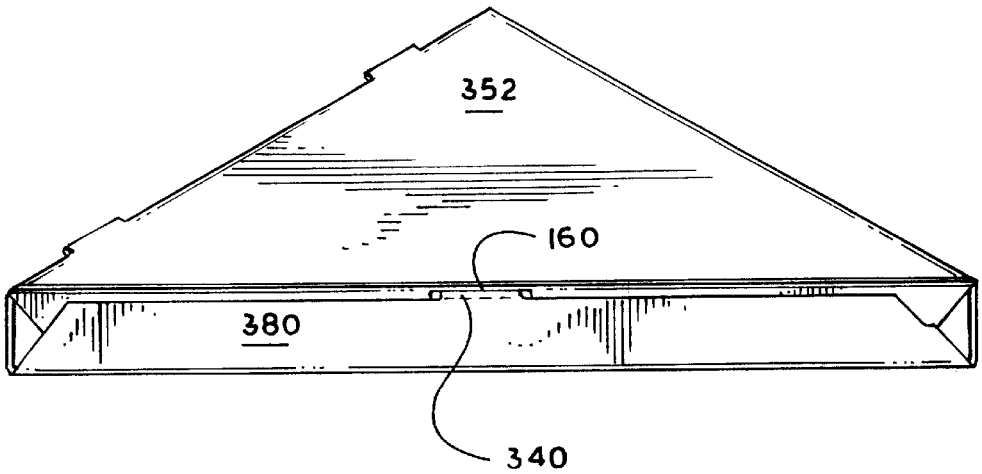

To form triangularly-shaped pizza box 18, the rectangularly-shaped pizza box 15 is torn along the above-described perforated tear lines to form a generally triangularly-shaped, smaller dimensioned pizza box blank, best seen with reference to FIG. 2. In order to complete the construction of triangularly-shaped pizza box 18, pieces 316, 314, 322, 380 are pivoted about fold lines 48, 44, 64, 90, respectively, upwardly approximately 90-degrees. Piece 320 is then pivoted along fold line 28 inwardly approximately 90-degrees. Next piece 352, along with pieces 314, 316, are folded up and over along fold line 56 toward piece 350, approximately 180-degrees, wherein pieces 314, 316 fit inside of pieces 322, 380, respectively, and wherein tab portion 340 is inserted within slit 160 to secure triangularly-shaped pizza box 18 in a closed position. The resulting construction is best seen with reference to FIGS. 3 and 4.

It should be noted that the perforated tear lines may vary in size and shape to adjust the degree of force needed to tear and reconfigure rectangularly-shaped pizza box 15 to triangularly-shaped pizza box 18.

As examples of further, useful benefits of the present invention, the perforated tear lines also serve to vent stream generated by the pizza within the rectangularly-shaped box to prevent the pizza contained therein from becoming soggy and undesirable. Also beneficially provided by the present invention, reconfiguration of the rectangularly-shaped box into a triangularly-shaped box does not typically require the removal of the pizza contained therein. Furthermore, in its reconfigured, triangular-shape, the box may fit into a standard-sized microwave oven for the user's convenience in re-heating any left-over pizza.

In view of the above disclosure, it will be further apparent that the variable sized and shaped pizza box of the present invention may further be formed with additional series of tear lines so as to enable the approximately triangular pizza box to be reconfigured by a user into a yet smaller triangular pizza box or boxes.

With regard to all such embodiments as may be herein described and contemplated, it will be appreciated that optional features, including, but not limited to, aesthetically pleasing coloration and surface design, and labeling and brand marking, may be provided in association with the present invention, all without departing from the scope of the invention.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A variable sized and shaped pizza box, comprising:

a blank of material for forming an approximately rectangular pizza box;

a plurality of fold lines formed in said blank of material for forming said pizza box with a top, a bottom, two bottom side walls, a bottom front side wall, two top side walls, and a top front side wall, and further comprising two spaced-apart fold lines formed near the center of the blank for forming a rear side wall; and, a plurality of tear lines formed in said blank of material and disposed so as to enable separation of said blank along said tear lines such that said approximately rectangular pizza box may be reconfigured into an approximately triangular pizza box, said plurality of tear lines further comprising:

a first tear line beginning approximately at one side edge of the pizza box and extending approximately along and parallel with the fold line proximal to the front edge, to a predetermined point which is located at a distance equal to approximately twice the height of a side wall of the box;

a second tear line extending from said point at approximately a 135-degree angle and extending to the fold line formed proximal to the opposite side edge of the pizza box;

a third tear line located at approximately the mid-point between the two side edges, said third tear line interrupting said second tear line by forming a generally U-shaped tab portion extending generally downward from, and perpendicular to, said second tear line;

a fourth tear line extending upwardly from the end of said second tear line and approximately along the fold line to approximately the first spaced-apart fold line formed near the center of the blank for forming the rear side wall of the pizza box when folded;

a fifth tear line extending outward to the proximal side edge;

a sixth tear line beginning approximately at the intersection of the second spaced-apart fold line formed near the center and the side edge fold line proximal thereto, and extending upwardly along said side edge fold line a predetermined distance equal to approximately the height of a side wall of the box;

a seventh tear line extending therefrom at approximately a 45-degree angle until said seventh tear line intersects the fold line proximal to the rear edge of the blank; and, an eighth tear line extending generally along the fold line proximal to the rear edge to the same side edge as the first tear line begins.

2. The variable sized and shaped pizza box of claim 1 further comprising two additional fold lines formed in said blank to enable folding of the two edges formed by said second and seventh tear lines to form one side of the triangularly-shaped pizza box when in the closed position.

3. The variable sized and shaped pizza box of claim 1 further comprising cooperating tab and slit elements for closure of said triangular pizza box.

4. A variable sized and shaped pizza box, comprising:

an approximately rectangular blank of material, said blank further comprising fold lines formed near the edges thereof and spaced a distance therefrom, said fold lines being disposed for forming the pizza box with a top, a bottom, two bottom side walls, a bottom front side wall, two top side walls, and a top front side wall, and further comprising two spaced-apart fold lines formed near the center of the blank for forming a rear side wall;

said blank further comprising a plurality of tear lines, said plurality of tear lines comprising:

a first tear line beginning approximately at one side edge of the pizza box and extending approximately along and parallel with the fold line proximal to the front edge, to a predetermined point which is located at a distance equal to approximately twice the height of a side wall of the box;

a second tear line extending from said point at approximately a 135-degree angle and extending to the fold line formed proximal to the opposite side edge of the pizza box;

a third tear line located at approximately the mid-point between the two side edges, said third tear line interrupting said second tear line by forming a generally U-shaped tab portion extending generally downward from, and perpendicular to, said second tear line;

a fourth tear line extending upwardly from the end of said second tear line and approximately along the fold line to approximately the first spaced-apart fold line formed near the center of the blank for forming the rear side wall of the pizza box when folded;

a fifth tear line extending outward to the proximal side edge;

a sixth tear line beginning approximately at the intersection of the second spaced-apart fold line formed near the center and the side edge fold line proximal thereto, and extending upwardly along said side edge fold line a predetermined distance equal to approximately the height of a side wall of the box;

a seventh tear line extending therefrom at approximately a 45-degree angle until said seventh tear line intersects the fold line proximal to the rear edge of the blank; and, an eighth tear line extending generally along the fold line proximal to the rear edge to the same side edge as the first tear line begins;

wherein when said pizza box is folded about said fold lines, said pizza box is rectangular shaped, and wherein when said blank of material is torn about said tear lines and folded about said fold lines, said pizza box is triangularly shaped.

5. The variable sized and shaped pizza box of claim 4 further comprising two additional fold lines formed in said blank to enable folding of the two edges formed by said second and seventh tear lines to form one side of the triangularly-shaped pizza box when in the closed position.

6. The variable sized and shaped pizza box of claim 4 further comprising a slit formed proximal to the fold line that is distal from said tab portion formed by the third tear line for receiving said tab portion therein to secure the triangularly-shaped pizza box in the closed position.

7. A process for forming a variable sized and shaped pizza box, comprising the steps of:

(a) obtaining a blank of material;

(b) forming a plurality of fold lines in said blank of material; and, (c) forming a plurality of tear lines in said blank of material, said tear lines disposed so as to enable separation of said blank along said tear lines such that said approximately rectangular pizza box may be reconfigured into an approximately triangular pizza box, said tear lines comprising:

a first tear line beginning approximately at one side edge of the pizza box and extending approximately along and parallel with the fold line proximal to the front edge, to a predetermined point preferably less than half the width of the pizza box;

a second tear line extending from said point at approximately a 135-degree angle and extending to the fold line formed proximal to the opposite side edge of the pizza box;

a third tear line located at approximately the mid-point between the two side edges, said third tear line interrupting said second tear line by forming a generally U-shaped tab portion extending generally downward from, and perpendicular to, said second tear line;

a fourth tear line extending upwardly from the end of said second tear line and approximately along the fold line to approximately the first spaced-apart fold line formed near the center of the blank for forming the rear side wall of the pizza box when folded;

a fifth tear line extending outward to the proximal side edge;

a sixth tear line beginning approximately at the intersection of the second spaced-apart fold line formed near the center and the side edge fold line proximal thereto, and extending upwardly along said side edge fold line a predetermined distance equal to approximately the height of a side wall of the box;

a seventh tear line extending therefrom at approximately a 45-degree angle until said seventh tear line intersects the fold line proximal to the rear edge of the blank; and, an eighth tear line extending generally along the fold line proximal to the rear edge to the same side edge as the first tear line begins, wherein when said pizza box is folded about said fold lines, said pizza box is rectangularly shaped, and wherein when said blank of material is torn about said tear lines and folded about said fold lines, said pizza box is triangularly shaped.

8. The process for forming a variable sized and shaped pizza box of claim 7, further comprising the forming of the variable sized and shaped pizza box with two additional fold lines in said blank to enable folding of the two edges formed by said second and seventh tear lines to form one side of the triangularly-shaped pizza box when in the closed position.

9. The process for forming a variable sized and shaped pizza box of claim 7, further comprising the forming of cooperating tab and slit elements in said blank for closure of said triangular pizza box.

10. A variable sized and shaped pizza box, comprising:

a blank of material for forming an approximately rectangular pizza box;

a plurality of fold lines formed in said blank of material for forming said pizza box with a top, a bottom, two bottom side walls, a bottom front side wall, two top side walls, and a top front side wall, and further comprising two spaced-apart fold lines formed near the center of the blank for forming a rear side wall; and, a plurality of tear lines formed in said blank of material and disposed so as to enable separation of said blank along said tear lines such that said approximately rectangular pizza box may be reconfigured into an approximately triangular pizza box, said plurality of tear lines further comprising:

a first tear line beginning approximately at one side edge of the pizza box and extending approximately along and parallel with the fold line proximal to the front edge, to a predetermined point which is located at a distance equal to approximately twice the height of a side wall of the box;

a second tear line extending from said point at approximately a 135-degree angle and extending to the fold line formed proximal to the opposite side edge of the pizza box;

a third tear line extending upwardly from the end of said second tear line and approximately along the fold line to approximately the first spaced-apart fold line formed near the center of the blank for forming the rear side wall of the pizza box when folded;

a fourth tear line extending outward to the proximal side edge;

a fifth tear line beginning approximately at the intersection of the second spaced-apart fold line formed near the center and the side edge fold line proximal thereto, and extending upwardly along said side edge fold line a predetermined distance equal to approximately the height of a side wall of the box;

a sixth tear line extending therefrom at approximately a 45-degree angle until said seventh tear line intersects the fold line proximal to the rear edge of the blank; and, a seventh tear line extending generally along the fold line proximal to the rear edge to the same side edge as the first tear line begins.

11. The variable sized and shaped pizza box of claim 10 further comprising cooperating tab and slit elements for closure of said triangular pizza box.

12. The variable sized and shaped pizza box of claim 10 further comprising two additional fold lines formed in said blank to enable folding of the two edges formed by said second and sixth tear lines to form one side of the triangularly-shaped pizza box when in the closed position.

* * * * *